United States Patent [19]

Briconi

[11] Patent Number: 4,470,869

[45] Date of Patent: Sep. 11, 1984

[54] DEVICE FOR TURNING BACK AN END OF A FLEXIBLE STRIP

[75] Inventor: Enrico Briconi, Chiari, Italy

[73] Assignee: Battista Lozio & Figli S.p.A., Monza, Italy

[21] Appl. No.: 438,809

[22] Filed: Nov. 3, 1982

[30] Foreign Application Priority Data

Nov. 4, 1981 [IT] Italy ..... 24842 A/81

[51] Int. Cl.[3] ..... B32B 3/04

[52] U.S. Cl. ..... 156/443; 156/226; 156/477.1; 156/478

[58] Field of Search ..... 156/478–481, 156/443, 477.1

[56] References Cited

U.S. PATENT DOCUMENTS

| | | | |
|---|---|---|---|
| 1,657,911 | 1/1928 | Anthony | 156/480 |
| 2,756,805 | 7/1956 | Silverman | 156/479 |
| 2,807,307 | 9/1957 | Brooks et al. | 156/443 |
| 2,828,796 | 4/1958 | Loew | 156/443 X |
| 3,047,047 | 7/1962 | Winberg | 156/443 X |
| 4,019,944 | 4/1977 | Tomita | 156/479 X |
| 4,124,424 | 11/1978 | Preston | 156/443 X |

*Primary Examiner*—David A. Simmons
*Attorney, Agent, or Firm*—Karl F. Ross

[57] ABSTRACT

A device designed to fold the end of a flexible strip back upon itself, e.g. to finish an extremity of a belt fitting into a buckle, comprises a depressible block with a front edge shaped to conform to the desired outline of the strip end. In its normal elevated position, the block is flush with a horizontally movable slider having a complementary confronting rear edge; the block is also overlain by two juxtaposed vertical plungers which are independently displaceable, the forward one of these plungers having a profile conforming to and aligned with the front edge of the block. After an extremity of a strip to be shaped has been placed on the block and on part of the adjoining slider, which is maintained at an elevated temperature by a heater juxtaposed therewith, the two plungers are lowered to depress the block through that extremity against a sustaining spring force below the level of the slider whereby parts of the strip overlying the slider are bent up between the rear edge of the latter and the profiled forward plunger which is thereupon withdrawn upward, allowing the slider to be shifted toward the other plunger above the repressed block so as to flatten the bent-up strip portion thereagainst; after the other plunger has also been retracted, the heated slider moves further across the block for thermally fixing the flattened portions in their new positions.

13 Claims, 16 Drawing Figures

DEVICE FOR TURNING BACK AN END OF A FLEXIBLE STRIP

FIELD OF THE INVENTION

My present invention relates to a device for shaping an extremity of a strip of flexible material, e.g. a garment belt, by turning back an end of that strip upon itself.

BACKGROUND OF THE INVENTION

In finishing garment belts or the like, it is customary to fold back a marginal portion of one belt end upon itself so as to impart to its transverse edge a curvature simplifying the introduction of that end into a belt buckle fastened to the opposite end. The folded-back parts of the shaped belt extremity are secured by adhesive bonding to the remainder of that extremity on the reverse side of the belt which in many instances is subsequently covered by a coextensive tape. As far as I am aware, these operations were heretofore performed exclusively by hand.

OBJECT OF THE INVENTION

The object of my present invention is to provide a device having means for mechanically shaping a strip extremity in the aforedescribed manner to facilitate the serial manufacture of garment belts or the like.

SUMMARY OF THE INVENTION

A device according to my invention comprises a sustaining member such as a spring-loaded block with a supporting surface having a front edge which conforms to a contour to be imparted to a strip extremity to be shaped, this front member being repressible against a restoring force in a direction transverse to that surface. The contoured front edge adjoins a confronting rear edge of a coacting thrust member, referred to hereinafter as a slider, in a normal position of the sustaining member in which its supporting surface is flush with an adjoining surface of the slider; the latter is reciprocable in a plane perpendicular to the transverse direction referred to. I further provide plunger means movable in that transverse direction and normally separated from the supporting surface of the sustaining member by a clearance enabling the strip extremity to be placed against this surface, with a marginal portion of such extremity overlying all or part of the adjoining slider surface. The plunger means can be advanced, with the aid of associated operating means, toward the sustaining member for clamping the strip extremity against its supporting surface and repressing this member perpendicularly thereto with reference to the slider whereby the aforementioned marginal portion is bent transversely to the supporting surface by the rear slider edge. The slider is coupled with drive means enabling its rearward displacement across the repressed sustaining member upon withdrawal of the plunger means therefrom, this displacement flattening the bent-over marginal portion against the remainder of the strip extremity which rests on the supporting surface.

It will generally be convenient to make the supporting surface horizontal and to let the plunger means descend substantially vertically from above to clamp the strip extremity thereagainst, although this mode of orientation is not essential.

Pursuant to a more particular feature of my invention, I prefer to divide the plunger means into a first and a second plunger juxtaposed with each other, the first plunger having a profile which conforms to the configuration of the front edge of the sustaining member and is aligned therewith so as to constitute a continuation thereof—in the direction transverse to the supporting surface—when that plunger is in its advanced or clamping position. The two plungers are independently displaceable by respective actuators forming part of the operating means, i.e. a first actuator coacting with the forwardly disposed first plunger and a second actuator coacting with the rearwardly disposed second plunger. These actuators are jointly operable to repress the sustaining member against its restoring force in the advanced plunger positions in which the marginal portion lifted off the slider surface enters a narrow gap separating the slider from the first plunger. The actuators, however, are independently retractable for successively withdrawing the first and the second plunger from their respective advanced positions, the withdrawal of the first plunger being followed by a rearward motion of the slider over an area of the supporting surface facing that first plunger while the sustaining member is still held repressed by the second plunger; when the latter plunger has been withdrawn, the slider motion continues over at least part of the area now vacated by that plunger.

The actuators may comprise cam-controlled pushers adapted to lock the plungers in their advanced positions.

Advantageously, the slider is provided with heating means for enabling a thermal bonding of the flattened marginal portion against the remainder of the strip extremity.

BRIEF DESCRIPTION OF THE DRAWING

The above and other features of my present invention will now be described in detail with reference to the accompanying drawing in which.

SPECIFIC DESCRIPTION

Figure 1A:
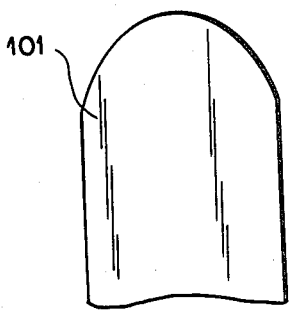
FIGS. 1*a*, 1*c*, 1*e* and 1*g* are views of the obverse sides of several belt extremities shaped by a device embodying my invention.
Figure 1B:
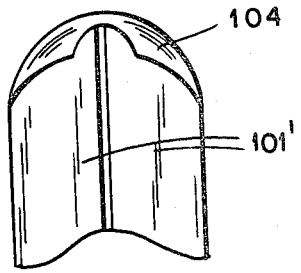
FIGS. 1*b*, 1*d*, 1*f* and 1*h* are corresponding view of the reverse sides of these belt extremities.

In FIGS. 1*a* and 1*b* I have shown opposite sides of an extremity of a garment belt 101, of leather or other flexible material, having a rounded edge of roughly parabolical configuration designed to be fitted into a buckle on the nonillustrated opposite end of the belt. The reverse side of the belt, seen in FIG. 1*b*, has lateral strip portions 101' folded over toward its centerline as well as a turned-back marginal portion 104 overlying these strip portions to form the curved transverse edge.

Figure 1C:
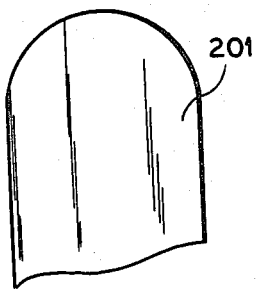
Figure 1D:
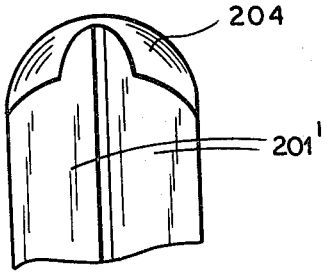

FIGS. 1*c* and 1*d* show an extremity of a similar belt 201 with strip portions 201' and a marginal portion 204, folded back as in the preceding instance, to define a transverse edge whose curvature is substantially semicircular.

Figure 1E:
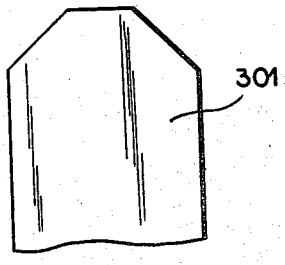
Figure 1F:
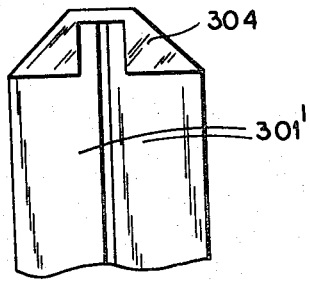

An extremity of a belt 301 shown in FIGS. 1*e* and 1*f*, with strip portions 301' and a marginal portion 304, has a trapezoidal transverse edge.

Figure 1G:
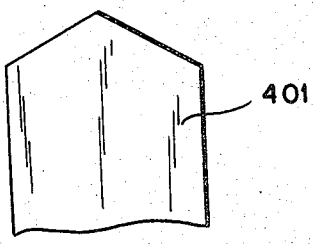
Figure 1H:
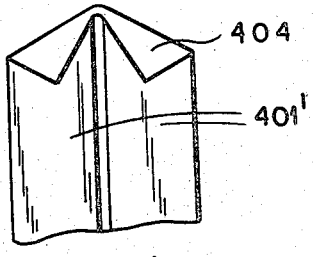

FIGS. 1*g* and 1*h* depict an extremity of a belt 401 with a triangularly pointed edge, having strip portions 401' and a marginal portion 404 folded back thereover.

Figure 2:
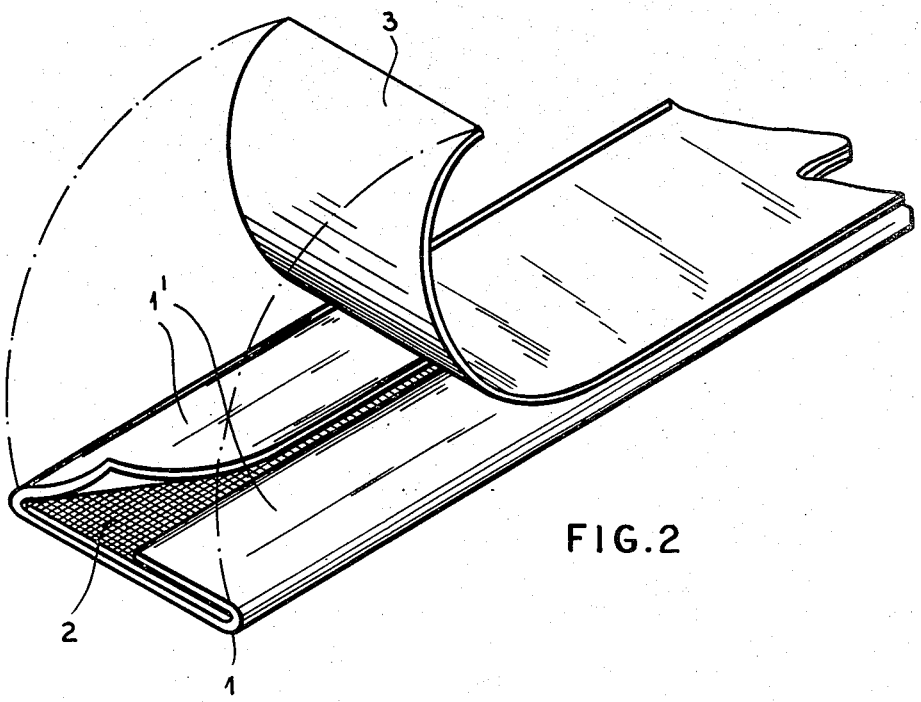
FIG. 2 is a perspective view of such a belt extremity prior to being shaped by a device according to my invention.
Figure 3:
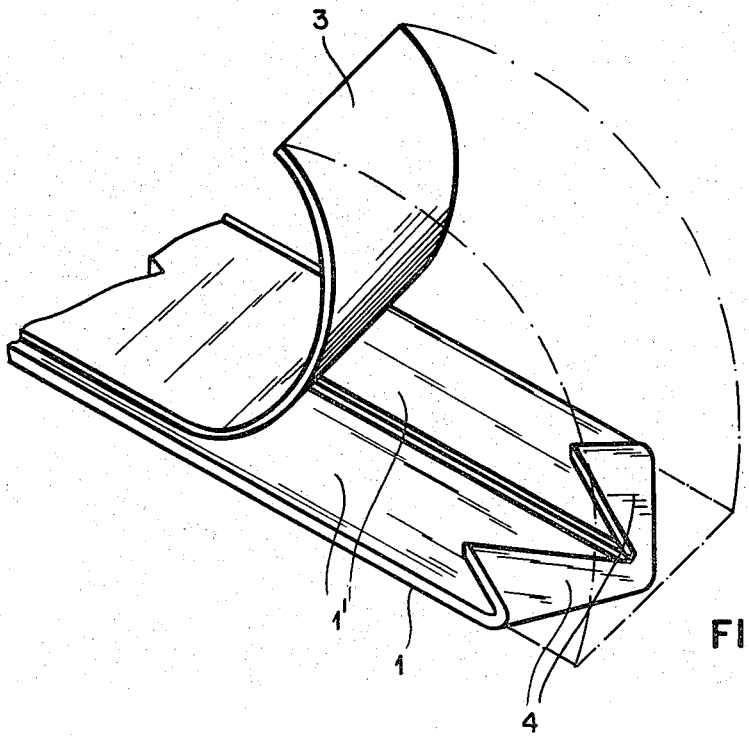
FIG. 3 is a perspective view similar to that of FIG. 2, showing the same belt extremity after shaping.

In the following description it will be assumed that an extremity of a belt 1, shown in FIGS. 2 and 3, is to be given the pointed shape illustrated in FIGS. 1*g* and 1*h*. It should be understood, however, that other configuration including those shown in FIGS. 1*a*–1*f* can be produced in an analogous manner.

FIG. 2 shows strip portions 1' of belt 1 folded over an insert or liner 2 of cloth, for example, and overlain by a finishing tape 3 (e.g. also of fabric) glued to the belt on its reverse side; an end of tape 3, however, has been lifted off to expose the belt extremity to be shaped.

FIG. 3 shows the same belt extremity after shaping, with a bilobate marginal portion 4 turned back onto strip portions 1' but before a bonding or rebonding of tape 3 to that extremity. The tape, after such bonding, is to be trimmed at its corners to conform to the pointed belt end, this step being generally performed by hand and being outside the scope of my present invention. Portion 4 is held in place by a heat-curable adhesive which may or may not be the same as that used for bonding the tape 3 thereto.

Figure 4:
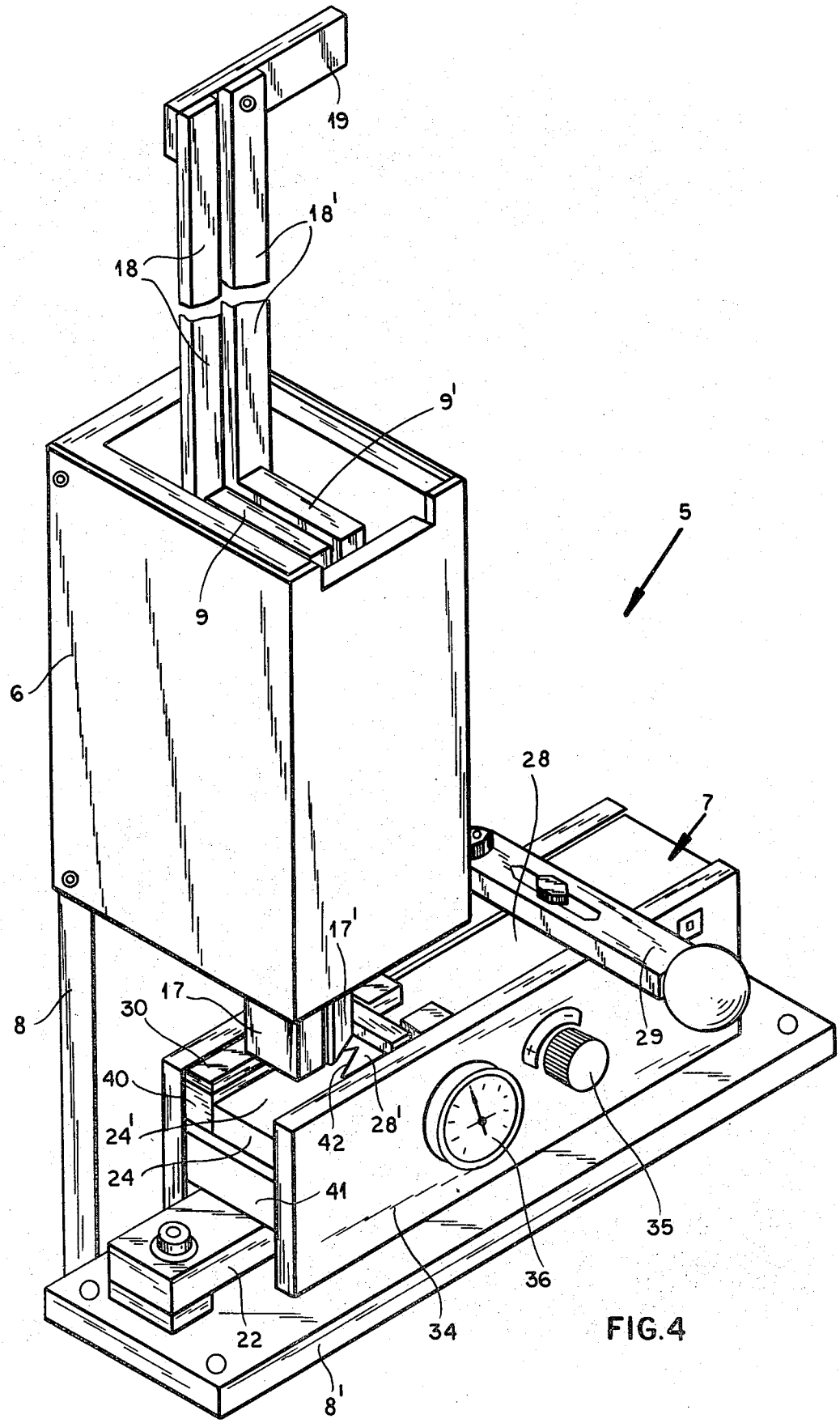
FIG. 4 is a perspective overall view of a device embodying my invention.

A device 5 according to my invention, designed to shape the end of belt 1, has been illustrated in its entirety in FIG. 4. This device comprises a frame 8 rigid with a base 8' and with an overhanging head 6 below which a shaping and bonding unit 7 is supported on that base 8.

Figure 5:
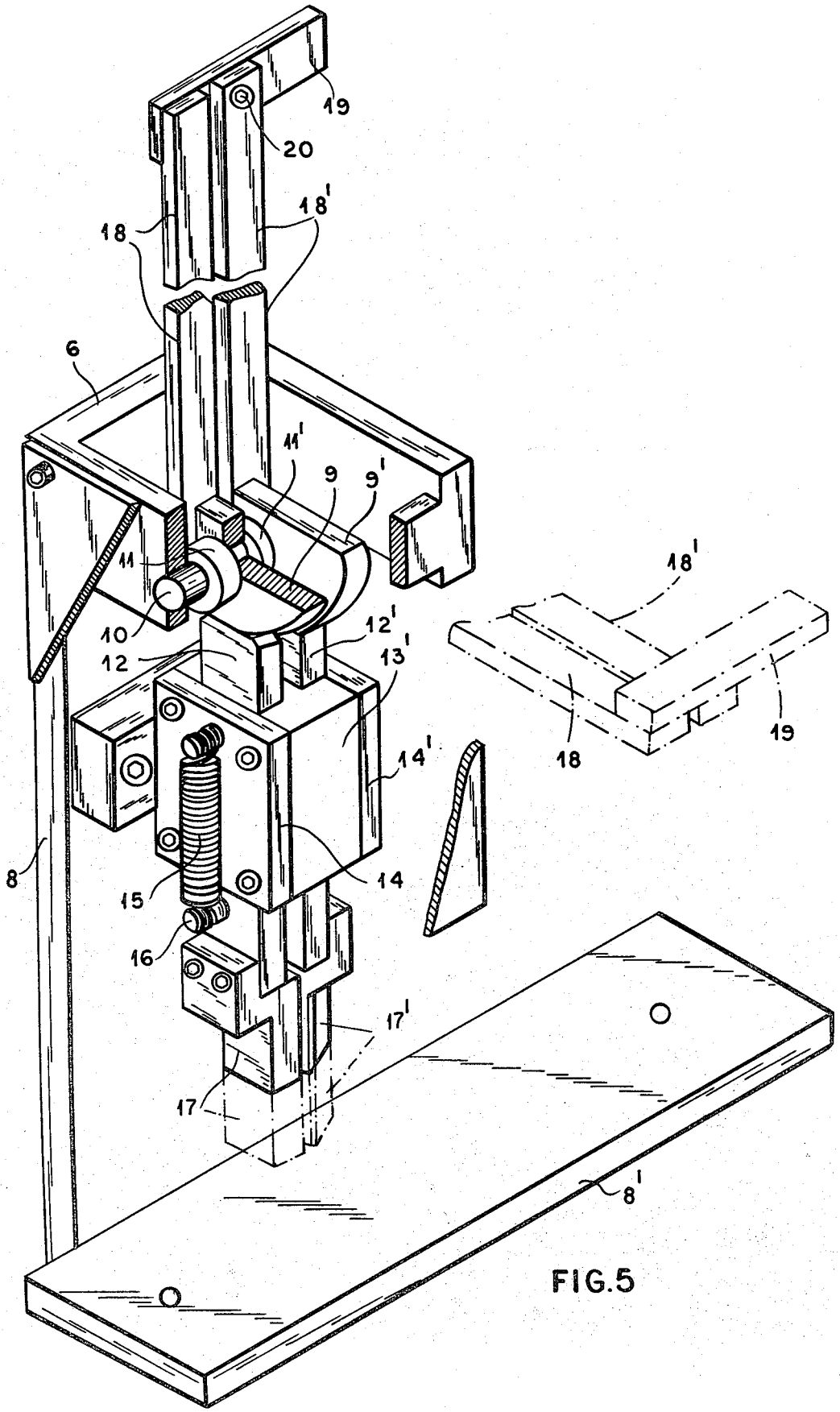
FIG. 5 is a view similar to that of FIG. 4 but with parts removed to expose other components.

Head 6, whose internal structure is seen in FIG. 5, is traversed by a horizontal pin 10 on which two identical cams 9 and 9' are swingably mounted together with spacers 11, 11' separating these cams from each other and from an adjoining wall. The curved undersides of cams 9 and 9' bear upon the tops of respective pushers 12 and 12' which are vertically guided in a stationary block 13 between end walls 14 and 14' thereof. Tension springs 15 (only one shown) anchored to these end walls are attached to studs 16 on the lower ends of these pushers so as to tend to hold them elevated against the cam surfaces. Two closely juxtaposed plungers 17 and 17' are movaly bolted onto the lower ends of pushers 12 and 12' for possible replacement by plungers of different profiles. The more forwardly positioned plunger 17' (as viewed in the insertion direction of belt 1, FIGS. 6 and 7) has a triangular front profile conforming to that of a front edge of a vertically movable sustaining member or block 24 (FIGS. 4 and 6–9) aligned therewith; the rearwardly positioned plunger 17 has a jagged profile, best seen in FIG. 8, which essentially conforms to the free edge of marginal portin 4 seen in FIG. 3.

Figure 8:
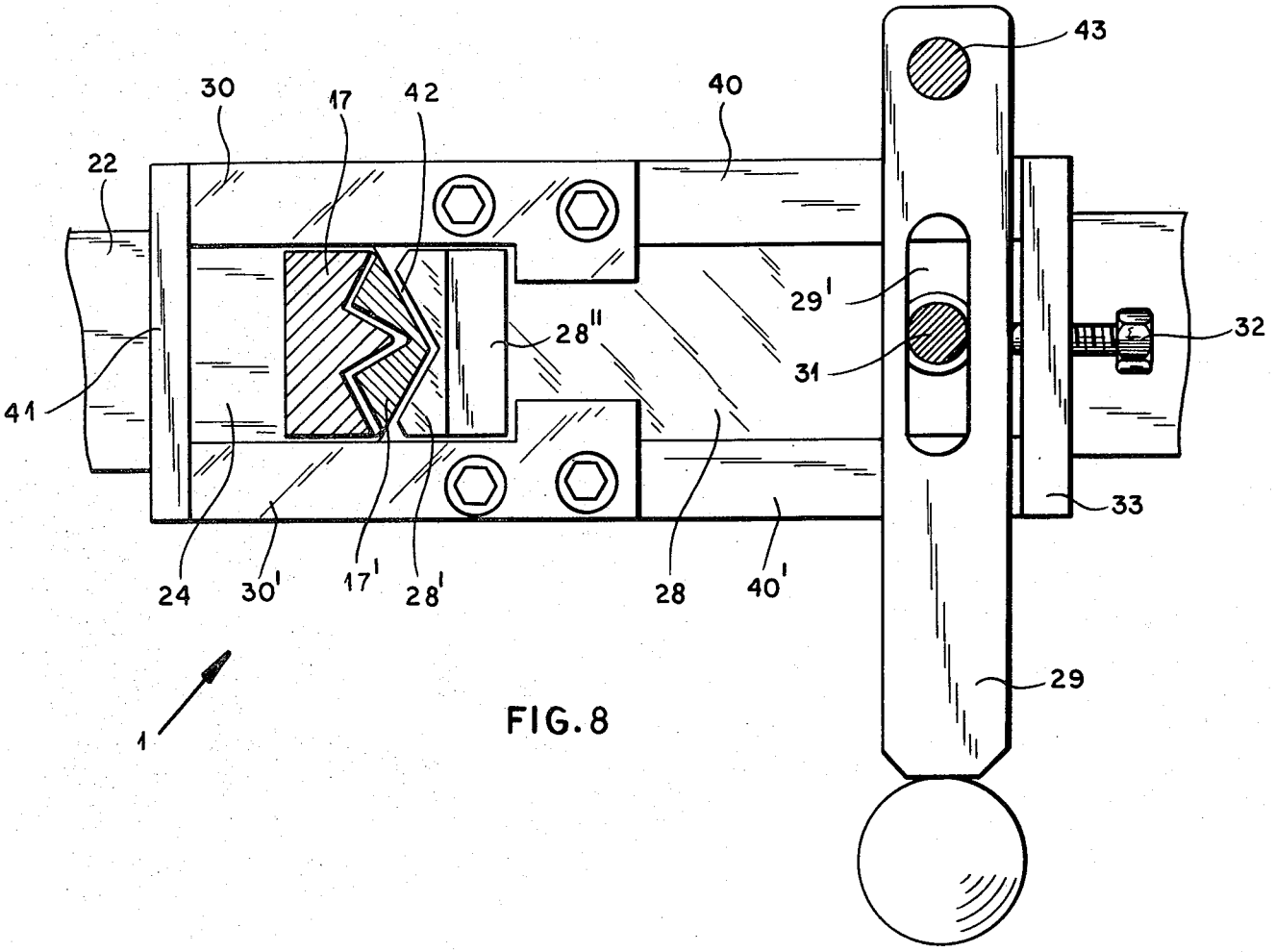
FIG. 8 is a top view of the unit shown in FIGS. 6 and 7.
Figure 9:
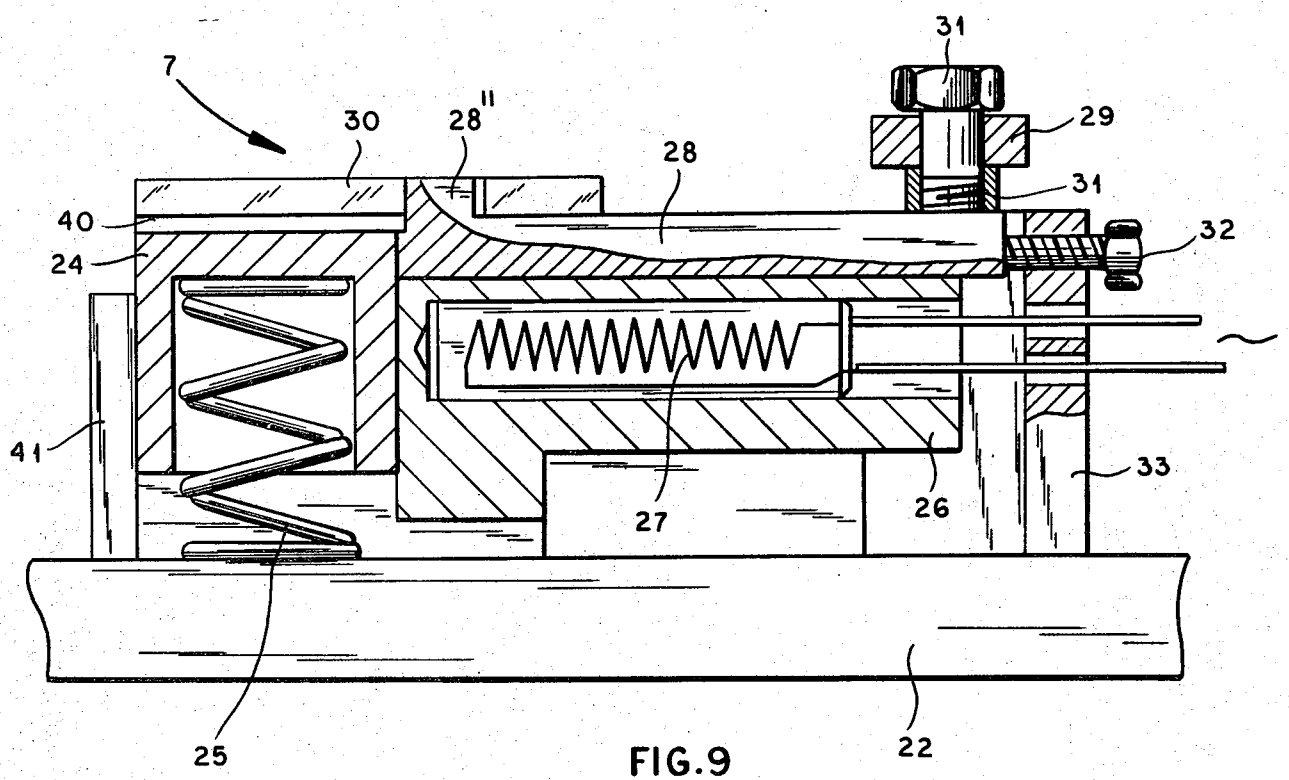
FIG. 9 is a side-elevational view of the same unit shown partly in section.

Cams 9 and 9' are rigid with respective operating arms 18 and 18' rising through the open top of head 6 in their normal position illustrated in FIG. 4 and in full lines in FIG. 5. A transverse handle 19, secured only to the top of arm 18' by a screw 20, reaches behind the top of arm 18 so that both arms can be jointly swung through about 90° into a working position illustrated in phantom lines in FIG. 5. In that working position the cams 9 and 9' are advanced toward an upper supporting surface 24' of block 24 so as to depress same against the force of a biasing spring 25 (FIGS. 6 and 9) which rests on a horizontal bar 22 overlying the base 8'. Bar 22 and block 24 form part of the shaping and bonding unit 7 which has sidewalls 23 and 23' as well as an end wall 41 confining the block 24 between them. Sidewalls 23 and 23' also bracket a stationary heater which comprises a thermally conductive housing 26 containing an electrically energized resistance element 27, housing 26 being overlain by a horizontally reciprocable thrust member 28 in the form of a flat slider which is guided between metallic ledges 40, 40' atop walls 23, 23' and is held down by brackets 30, 30' screwed onto these ledges as best seen in FIG. 8. Slider 28 has a surface portion 28' adjoining the supporting surface 24' of block 24 which is coplanar therewith in the normal, elevated position of that block, this position being defined by the ledges 40 and 40' overhanging respective shoulders 24'' of member 24. Surface portion 28' is bounded by an upstanding abutment 28'' of slider 28.

Figure 6:
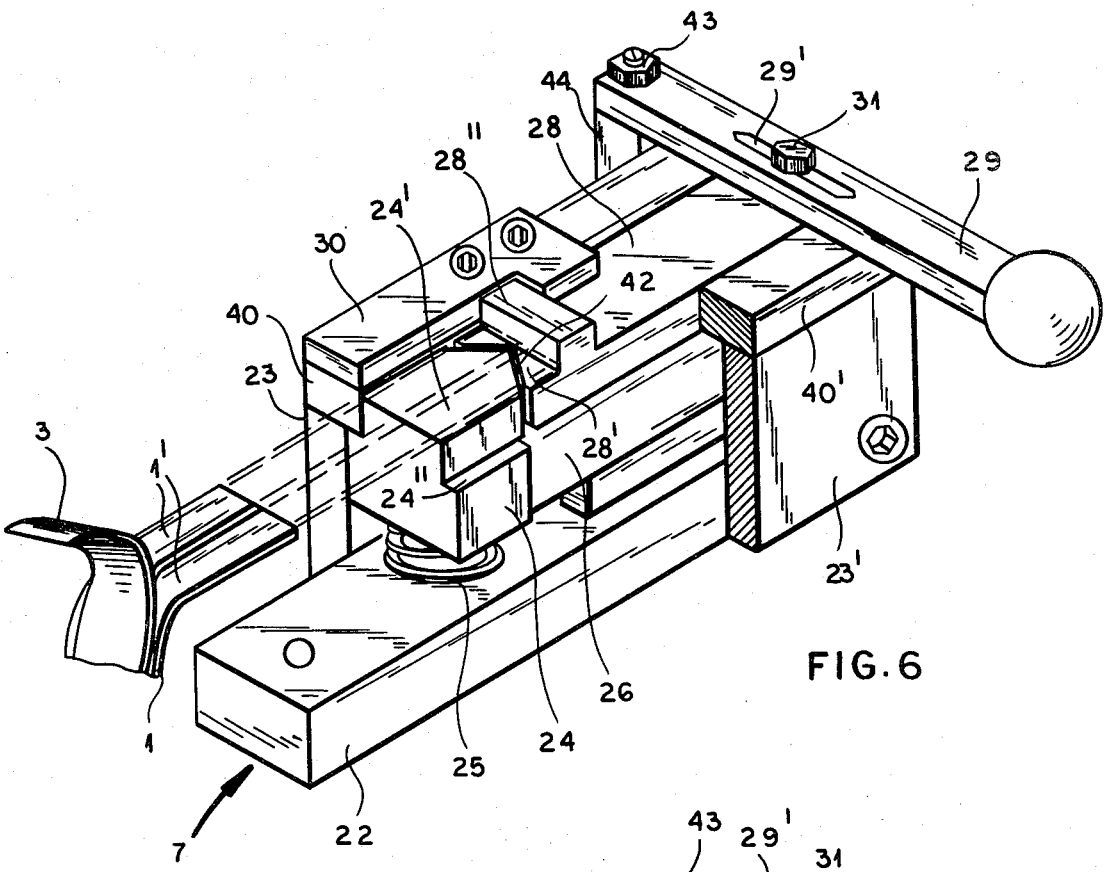
FIG. 6 is a perspective view of a shaping and bonding unit included in the device of FIG. 4 but omitted in FIG. 5.
Figure 7:
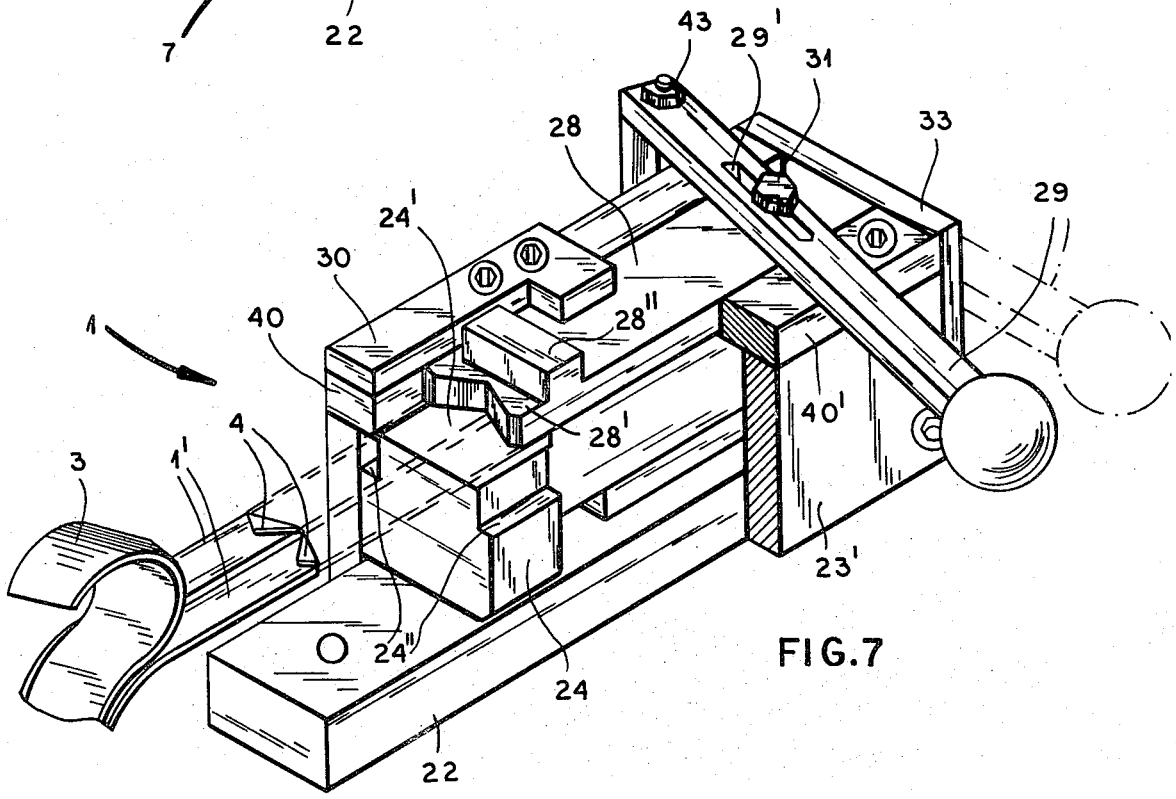
FIG. 7 is a view similar to that of FIG. 6, showing the unit in another phase of operation.

The triangularly profiled front edge of block 24 is confronted by a complementarily shaped rear edge of slider 28, the two edges being separated by a narrow gap 42 visible in FIGS. 4 and 6. When the plungers 17 and 17' are lowered onto surface 24' by a clockwise swing of handle 19 as viewed in FIG. 5, with resulting depression of block 24 below the level of slider 28 as seen in FIG. 7, the same gap 42 exists between the concave slider face and the convexly profiled front surface of the forward plunger 17'.

A lever 29, pivoted at 43 to a post 44 adjacent wall 23, is articulated to slider 28 by a screw 31 traversing a slot 29' of that lever. A horizontal swing of lever 29 from its normal position to an off-normal position, respectively illustrated in phantom and solid lines in FIG. 7, thus moves the slider 28 rearwardly over the supporting surface 24' of the depressed block 24. An adjustable stop for the slider 28, defining its normal position, is constituted by a bolt 32 screwed into an end wall 33 of unit 7. The slider may be biased toward that stop by a nonillustrated spring.

As further shown in FIG. 4, an outer wall 34 forming part of a thermally insulating casing for unit 7 carries a thermostat 35 and a thermometer 36 enabling the control and the observation of the temperature maintained inside that unit by heater 26, 27.

In operation, the extremity of a belt 1 to be shaped—initially having the configuration shown in FIG. 2—is placed on the supporting surface 24' of block 24 and on the adjoining surface 28' of slider 28 so as to contact the abutment 28'' with its transverse edge. Next, the handle 19 is swung into its phantom-line position to lower the plungers 17 and 17' into their advanced positions also indicated by phantom lines in FIG. 5. The two plungers, bearing upon the reverse side of the belt extremity, clamp that extremity between themselves and the block 24 even as that block is lowered against the biasing force of spring 25 into the position of FIG. 7. Marginal portion 4 is thereby bent upward along the confronting rear edge of slider 28 and comes to lie in the narrow gap between the slider face and the front profile of plunger 17'. It should be noted that the curvature of cams 9 and 9' is such that the peripheries of their large dwells are substantially perpendicular to the radial direction so that plungers 17 and 17' remain locked against the countervailing forces of springs 15 and 25 as long as handle 19 is thus swung down. When, now, that handle is returned to its normal position, it entrains only the operating arm 18' so that plunger 17 continues to hold the block 24 depressed even as plunger 17' is withdrawn. Handle 29 can now be moved to drive the slider 28 rearward, thereby flattening the upstanding marginal portion 4 onto the strips 1' and bonding it thereto with the aid of the adhesive previously provided on their exposed surfaces. The lobes of portion 4 fit neatly into the jagged profile of rear plunger 17 which is then also withdrawn, by a reverse swing of the associated operating arm 18, whereupon the slider 28 can be shifted further across the belt extremity resting on supporting surface 24'. The heated slider may be held in contact with that belt extremity for about 6 to 20 seconds to ensure the curing of the bonding agent. After the slider has been retracted to its normal position, the belt 1 can be removed from the device for completion of the finishing operation by the bonding and trimming of tape 3 as described above.

Plungers 17 and 17', supporting block 24, slider 28 and, if necessary, heater housing 26 may be replaced by corresponding components of different configurations in order to provide belt terminations of other shapes, e.g. as shown in FIGS. 1*a*–1*f*.

It should be understood that the described operations of handle 18, arm 18 and lever 29 may be performed automatically or semiautomatically by suitable servomechanisms, e.g. of fluidic or electromagnetic type, whose construction and programmed control will be readily apparent to persons skilled in the art.

I claim:

1. A device for shaping an extremity of a flexible strip comprising:

a sustaining member with a supporting surface having a front edge conforming to a contour to be imparted to a strip extremity to be shaped, said sustaining member being repressible against a restoring force from a normal position in a direction transverse to said supporting surface;

a coacting thrust member with a confronting rear edge of complementary shape adjoining said front edge in the normal position of said sustaining member in which said supporting surface is flush with an adjoining surface of said thrust member, the latter being reciprocable in a plane perpendicular to said transverse direction;

a first and a second plunger movable in said transverse direction and normally separated from said supporting surface by a clearance enabling said strip extremity to be placed against said supporting surface with a marginal portion overlying at least part of said adjoining surface, said first plunger facing a forward area of said supporting surface close to said thrust member, said second plunger facing another area of said supporting surface farther from said thrust member;

operating means coupled with said plungers for jointly advancing same toward said sustaining member and clamping said strip extremity against said supporting surface while repressing said sustaining member perpendicularly thereto with reference to said thrust member, thereby causing said marginal portion to be bent transversely to said supporting surface by said rear edge between said thrust member and said first plunger, said first and second plungers being successively retractable by said operating means for providing an interval during which said sustaining member is held repressed solely by said second plunger with said first plunger withdrawn from a part of said strip overlying said forward area; and drive means coupled with said thrust member for displacing same rearwardly across the repressed sustaining member upon withdrawal of said first plunger but before withdrawal of said second plunger by said operating means, thereby flattening said marginal portion against the remainder of said strip extremity resting on said forward area.

2. A device as defined in claim 1 wherein said thrust member is provided with an abutment bounding said adjoining surface.

3. A device as defined in claim 1 wherein said first plunger has a profile conforming to the configuration of said front edge and aligned therewith, said operating means comprising a first actuator coacting with said first plunger and a second actuator coacting with said second plunger, said actuators being jointly operable to repress said sustaining member against said restoring force in advanced positions of said plungers while allowing said marginal portion to enter a narrow gap separating said first plunger from the rear edge of said thrust member, said actuators being independently retractable for successive withdrawals of said first and second plungers from their respective advanced positions with intervening rearward motion of said thrust member over said forward area and continuation of said rearward motion following withdrawal of said second plunger.

4. A device as defined in claim 3 wherein said actuators comprise cam-operated pushers adapted to lock said plungers in the advanced positions thereof.

5. A device as defined in claim 4 wherein said pushers are provided with resetting springs tending to retract same from said sustaining member.

6. A device as defined in claim 5 wherein said sustaining member is a vertically guided spring-loaded block overhung by said plungers, said thrust member being a horizontally reciprocable slider.

7. A device as defined in claim 1 wherein said thrust member contacts stationary heating means for enabling a thermal bonding of the flattened marginal portion against the remainder of said strip extremity.

8. A device as defined in claim 2 wherein said thrust member contacts stationary heating means for enabling a thermal bonding of the flattened marginal portion against the remainder of said strip extremity.

9. A device as defined in claim 3 wherein said thrust member contacts stationary heating means for enabling a thermal bonding of the flattened marginal portion against the remainder of said strip extremity.

10. A device as defined in claim 4 wherein said thrust member contacts stationary heating means for enabling a thermal bonding of the flattened marginal portion against the remainder of said strip extremity.

11. A device as defined in claim 5 wherein said thrust member contacts stationary heating means for enabling a thermal bonding of the flattened marginal portion against the remainder of said strip extremity.

12. A device as defined in claim 6 wherein said slider has an upstanding abutment bounding said adjoining surface.

13. A device as defined in claim 6 wherein said block and said slider are enclosed in a thermally insulating casing provided with heating means juxtaposed with said slider for maintaining same at an elevated temperature facilitating a thermal bonding of the flattened marginal portion to the remainder of said strip extremity.

* * * * *